US005122839A

United States Patent [19]

Siegel et al.

[11] Patent Number: 5,122,839

[45] Date of Patent: Jun. 16, 1992

[54] DUAL ACTION BLADE CLEANER

[75] Inventors: Robert P. Siegel, Penfield; Bruce E. Thayer, Webster, both of N.Y.

[73] Assignee: Xerox Corporation, Stamford, Conn.

[21] Appl. No.: 689,392

[22] Filed: Apr. 22, 1991

[51] Int. Cl.[5] ..... G03G 15/01

[52] U.S. Cl. ..... 355/299; 430/125; 15/256.5

[58] Field of Search ..... 355/211, 296, 297, 299, 355/269; 430/125; 15/256.5, 256.51

[56] References Cited

U.S. PATENT DOCUMENTS 3,843,407 10/1974 Thorp ..... 134/299
3,940,282 2/1976 Hwa ..... 134/299
4,264,191 4/1981 Gerbasi et al. ..... 355/299
4,279,500 7/1981 Kondo et al. ..... 355/299
4,870,465 9/1989 Lindblad et al. ..... 355/296

*Primary Examiner*—A. T. Grimley
*Assistant Examiner*—P. Stanzione
*Attorney, Agent, or Firm*—H. Fleischer; J. E. Beck; R. Zibelli

[57] ABSTRACT

A cleaning blade having a dual action cleaning blade. One side of the cleaning blade is coated with an abrasive material. The cleaning blade is used in an electrophotographic printing machine to remove residual particles from a photoconductive surface.

23 Claims, 4 Drawing Sheets

DUAL ACTION BLADE CLEANER

BACKGROUND OF THE INVENTION

This invention relates generally to an electrophotographic printing device, and more particularly, a cleaning blade used therein to remove particles adhering to the photoconductive member.

In the process of electrophotographic printing, a photoconductive surface is charged to a substantially uniform potential. The photoconductive surface is imagewise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a sheet of support material and permanently affixed thereto.

This process is well known and useful for light lens copying from an original and printing applications from electronically generated or stored originals, and in ionography.

In a reproduction process of the type as described above, it is inevitable that some residual toner will remain on the photoconductive surface after the toner image has been transferred to the sheet of support material (e.g. paper). It has been found that with such a process that the forces holding some of the toner particles to the imaging surface are stronger than the transfer forces and, therefore, some of the particles remain on the surface after transfer of the toner image. In addition to the residual toner, other particles, such as paper debris (i.e. Kaolin, fibers, clay), additives and plastic, are left behind on the surface after image transfer. (Hereinafter, the term "residual particles" encompasses residual toner and other residual debris remaining after image transfer.) The residual particles adhere firmly to the surface and must be removed prior to the next printing cycle to avoid its interfering with recording a new latent image thereon.

Various methods and apparatus may be used for removing residual particles from the photoconductive imaging surface. Hereinbefore, a cleaning brush, a cleaning web, and a cleaning blade have been used. Both cleaning brushes and cleaning webs operate by wiping the surface so as to affect transfer of the residual particles from the imaging surface thereon. After prolonged usage, however, both of these types of cleaning devices become contaminated with toner and must be replaced. This requires discarding the dirty cleaning devices. In high-speed machines this practice has proven not only to be wasteful but also expensive.

The shortcomings of the brush and web made way for another now prevalent form of cleaning known and disclosed in the art—blade cleaning. Blade cleaning involves a blade, normally made of a rubberlike material (e.g. polyurethane) which is dragged or wiped across the surface to remove the residual particles from the surface. Blade cleaning is a highly desirable method, compared to other methods, for removing residual particles due to its simple, inexpensive structure. However, there are certain deficiencies in blade cleaning, which are primarily a result of the frictional sealing contact that must occur between the blade and the surface.

Dynamic friction is the force that resists relative motion between two bodies that come into contact with each other while having separate motion. This friction between the blade edge and the surface causes wearing away of the blade edge, and damages the blade's contact with the surface. For purposes of this application, volume wear (W) is proportional to the load (F) multiplied by the distance (D) traveled. Thus, $W \propto FD \propto FVT$, or introducing a factor of proportionality K, $W = KFVT$ where K is the wear factor, V is the velocity and T is the elapsed time. Hence, wear increases with larger values of K. Various blade lubricating materials or toner lubricant additives have been proposed to reduce friction which would thereby reduce wear. However, lubricants tend to change the operational characteristics of the printing machine undesirably. For example, a polyurethane blade with a good lubricant in the toner can ideally achieve a frictional coefficient of about 0.5, however, this rarely occurs because of the delicate balance involved in achieving the proper weight percent of lubricant in the toner. (Normal frictional coefficient values for cleaning blades that remove toner off the imaging surface range from a low of about 0.5 to a high of about 1.5).

In addition to the problem of volume wear, blades are also subject to unpredictable failures. In normal operational configuration, with a coefficient of dynamic friction in the range of about 0.5 to about 1.5, a blade cleaning edge or tip in sealing contact with the surface is tucked slightly. The blade is not in intimate contact with the surface, but slides on toner particles and lubricant to maintain the sealing contact required for cleaning. In this configuration, the blade may flatten particles that pass under the blade and cause impaction of particles on the surface. This is called cometing because of the comet-like impressions created by the flattened particles. Also, the carrier beads remaining on the surface subsequent to development may damage the blade. Another common failure is localized increases in friction between the blade and surface that cause the phenomenon of severe tucking, where the blade cleaning edge becomes tucked underneath the blade. When this occurs the cleaning blade material can fracture in the region where the severe tuck occurs and damage the blade permanently. Still another common failure occurs at startup, when the frictional force between the blade and the surface is so high that it causes the blade to foldover on itself overstressing the blade. These types of failures require removal and replacement of the blade.

The commonly used elastomer-type cleaning blade is a resilient material that allows stubborn residual particles to remain on the surface. This occurs because the resilient elastomeric material is unable to provide sufficient contact to create a tight seal between the cleaning blade and the surface when tuck occurs, therefore the resiliency of the elastomeric blade makes it easy for the blade to glide over the residual particles. It is an object of this invention to provide a sufficiently abrasive blade surface to remove these stubborn residual particles and thus avoid the resiliency problem of the elastomer-type blade.

While it might appear that a rigid metal blade might solve the problems of rigidity and wear, in fact, the frictional contact required between the surface and blade quickly wears away the blade and any surface lubricants applied thereto. As the blade edge wears, it changes from a chiseling edge to a rounded or flattened surface which requires a high force to maintain the edge in sealing contact. While a beveled edge is useful in liquid toner applications, it is highly susceptible to damage and wear in dry toner applications. Accordingly, it is desirable to maintain the blade's square edge without wear. Additionally, wearing friction may generate toner fusing temperatures, causing toner to fuse to the blade, or the surface. Furthermore, filming on the surface can deteriorate image quality. Filming occurs either uniformly or as streaking, due to deficiencies in blade cleaning, requiring the use of a lubricant and a balancing abrasion element to prevent filming.

A current focus in the market place is on intelligent machines. These are intelligent in the way that they operate; meaning that they monitor their own performance and adapt to changing conditions. They are also perceived to be intelligent by their operators due to their ability to understand and satisfy the operators' objectives. An implicit requirement in the perception of intelligence is highest reliability, which translates to minimizing unscheduled maintenance and machine shut downs.

Concepts for these intelligent machines (a) enable a reliability improvement over the way machines are currently built, either through a self-sensing scenario or through inherently more reliable design, or (b) provide a feature that the operator would interpret as machine intelligence. The present invention is one such concept: Blade cleaners are often used in xerographic systems to remove toner from the photoreceptor which has not transferred onto the paper. It is also called upon to clean off the entire image in the event that a sheet of paper did not reach the transfer point in time to meet the image and a shutdown or jam is declared. Since the cleaner blade must remain continuously in contact with the photoreceptor belt it is essential that all of the critical blade design parameters (e.g. stiffness, angle, load etc.) be selected within an operating window that is bounded by some photoreceptor life on the other. The loading stiffness, etc., must be adequate to remove the normal toner residue but it will occasionally encounter toner agglomerates, foreign contaminants and impacted particles which will exceed the blades capability to clean. These particles will generally cause copy defects which are objectionable. It is an object of this invention to remove these stubborn particles that normal cleaning will not remove.

The following disclosures may be relevant to various aspects of the present invention and may be briefly summarized as follows:

U.S. Pat. No. 3,843,407 to Thorp describes a method and apparatus for blade cleaning of an imaging surface which is cleaned by contacting a blade while moving in the normal direction and temporarily reversing the direction of the imaging surface relative to the cleaning blade while maintaining the same contact of the cleaning blade with the imaging surface.

U.S. Pat. No. 3,940,282 to Hwa describes cleaning of reusable surfaces by blades with relative motion between an imaging surface and a blade. The motion of the imaging surface is reversed with the blade still engaged with imaging surface before each rest period.

U.S. Pat. No. 4,264,191 to Gerbasi et al. describes a laminated doctor blade for removing excess marking material or other material from a surface. The blade comprises a relatively hard layer of a smooth tough material and a relatively soft layer of resilient material.

SUMMARY OF INVENTION

Briefly stated, and in accordance with the present invention, there is provided an electrophotographic printing machine having a movable photoconductive surface upon which there are residual particles where the improvement of the present invention involves the removal of these residual particles. The printing machine includes means for cleaning residual particles from the photoconductive surface, where the cleaning means has a cleaning surface and an abrading surface. Means for providing bidirectional relative movement between the photoconductive surface and the blade so that in one direction the abrading surface engages the photoconductive surface and in the other direction the cleaning surface engages the photoconductive surface.

Pursuant to another aspect of the present invention, there is provided a dual function blade adapted to remove contaminates from a surface including an abrading surface, a cleaning surface and means for providing bidirectional relative movement between the surface and the blade so that in one direction the abrading surface engages the surface and in the other direction the cleaning surface engages the surface.

BRIEF DESCRIPTION OF THE DRAWINGS

Other features of the present invention will become apparent as the following description proceeds and upon reference to the drawings, in which:

FIG. 2(*b*) is a schematic elevation view illustrating the flexible wiper blade configuration of the cleaning blade in the abrading mode;

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
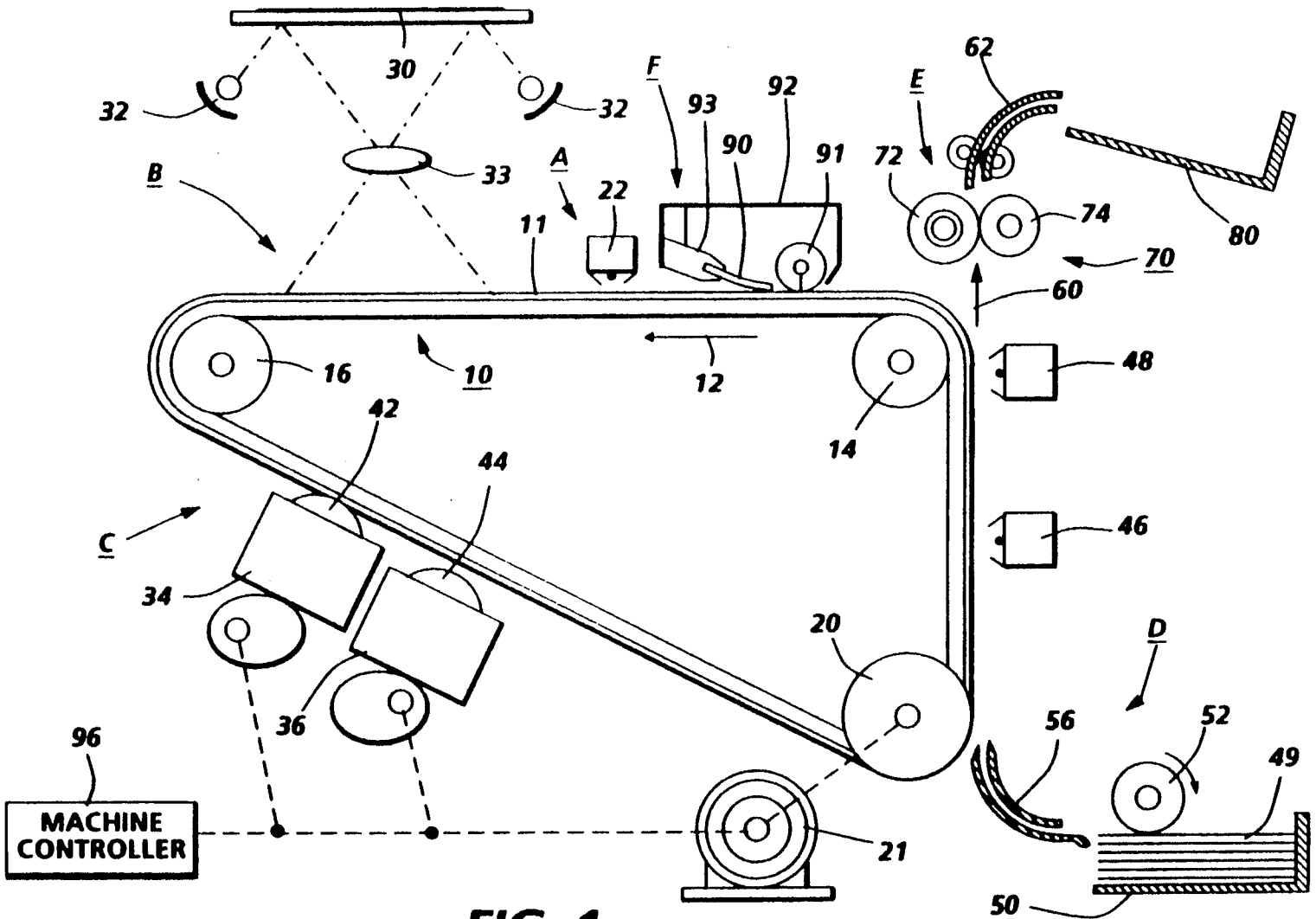
FIG. 1 is a schematic elevational view depicting an electrophotographic printing machine incorporating the features of the present invention therein.

For a general understanding of an electrophotographic printing machine in which the present invention may be incorporated, reference is made to FIG. 1 which depicts schematically the various components thereof. Hereinafter, like reference numerals will be employed throughout to designate identical elements. Although the cleaning apparatus of the present invention is particularly well adapted for use in an electrophotographic printing machine, it should become evident from the following discussion, that it is equally well suited for use in a wide variety of devices and is not necessarily limited to the particular embodiments shown herein.

Referring now to the drawings, where the showings are for the purpose of describing a preferred embodiment of the invention and not for limiting same, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

Figure 10:
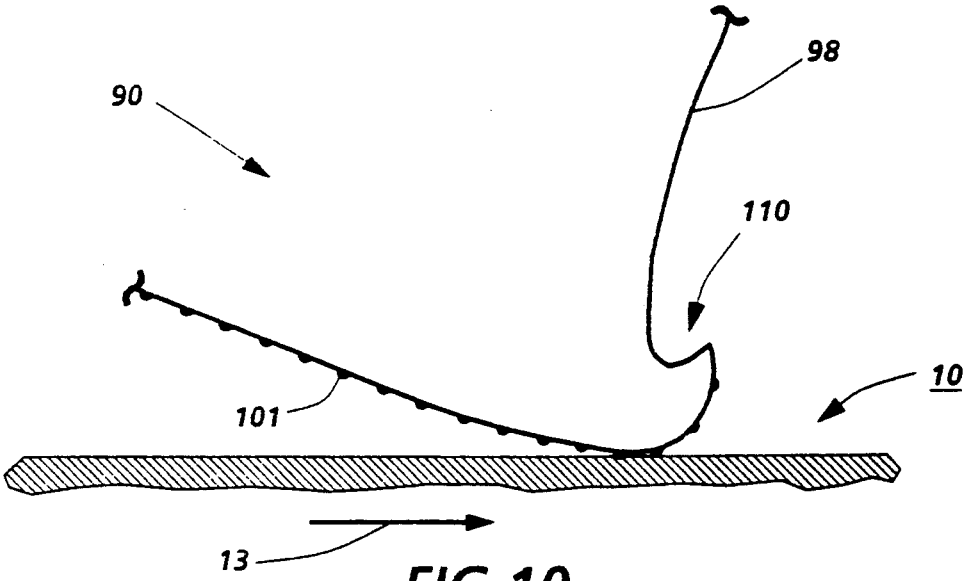
FIG. 10 is an enlarged view of the doctor blade configuration in the abrading mode.

A reproduction machine in which the present invention finds advantageous use utilizes a photoreceptor belt 10, having a photoconductive surface 11. Belt 10 moves in the direction of arrow 12 to advance successive portions of the belt sequentially through the various processing stations disposed about the path of movement thereof. (When the photoreceptor belt 10 is reversed it moves in the direction of arrow 13 as shown in FIG. 10). Belt 10 is entrained about stripping roller 14, tension roller 16, and drive roller 20. Drive roller 20 is coupled to a motor 21 by suitable means such as a belt drive. Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12 or the reversed direction of arrow 13.

With continued reference to FIG. 1, initially a portion of belt 10 passes through charging station A. At charging station A, a corona device 22 charges photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto a charged portion of photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, belt 10 advances the electrostatic latent image to development station C. At development station C, one of at least two developer housings 34 and 36 is brought into contact with belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e., carrier beads and toner) into contact with the electrostatic latent image. The electrostatic latent image attracts toner particles from the carrier beads, thereby forming toner powder images on photoreceptor belt 10. If two colors of developer material are not required, the second developer housing may be omitted.

Belt 10 then advances the developed latent image to transfer station D. At transfer station D, a sheet of support material such as paper copy sheets is advanced into contact with the developed latent images on belt 10. Corona generating device 46 charges the copy sheet to the proper potential so that it is tacked to photoreceptor belt 10 and the toner powder image is attracted from photoreceptor belt 10 to the sheet. After transfer, a corona generator 48 charges the copy sheet to an opposite polarity to detack the copy sheet from belt 10, whereupon the sheet is stripped from belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a backup roller 74 with the toner powder images contacting fuser roller 72. In this manner, the toner powder image is permanently affixed to the sheet, and such sheets are directed via a shoot 62 to an output 80 or finisher.

Residual particles remaining on photoreceptor belt 10 after each copy is made, may be removed at cleaning station F with the combination of a cleaning blade 90 and an auger 91 for removal of the residual particles within a housing 92. Removed residual particles may be stored for disposal.

Machine controller 96 is preferably a known programmable controller or combination of controllers, which conventionally control all the machine steps and functions described. Controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention.

It is believed that the foregoing description is sufficient for purposes of the present application to illustrate the general operation of an electrophotographic printing machine which exemplifies one type of apparatus employing the present invention therein. The dual action configuration of the cleaning blade 90 will be described hereinafter with reference to FIGS. 2 through 10.

Figure 2A:
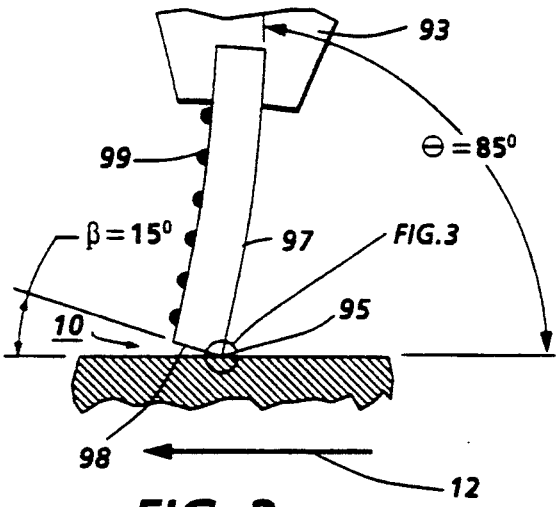
FIG. 2(*a*) is a schematic elevational view illustrating the flexible wiper blade configuration of the cleaning blade in the cleaning mode.
Figure 2B:
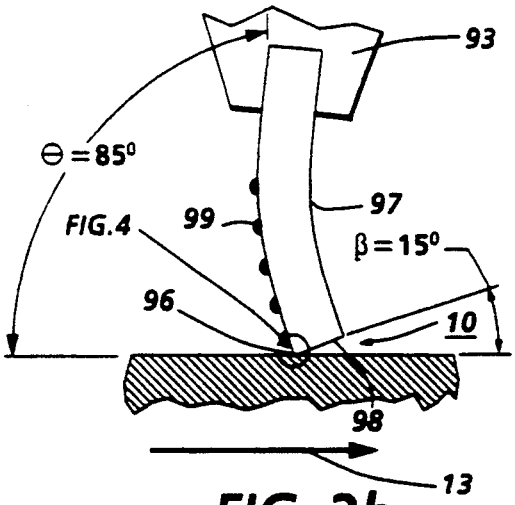
Figure 8:
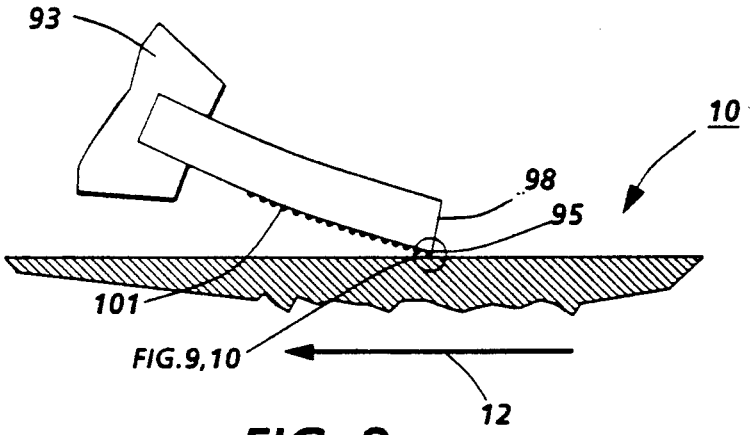
FIG. 8 is a schematic elevational view illustrating the doctor blade configuration of the cleaning blade.

Referring now to FIG. 2(*a*) which shows a cleaning blade 90 in a wiper mode cleaning relationship with a photoconductive surface 11 of belt 10. The wiper mode is so named because of the wiping motion and wiping contact made with the surface 11 by the cleaning blade 90 to remove the residual particles 18. In the doctoring mode that is depicted in FIG. 8, the cleaning blade edge 95 acts as a scraper in removing the residual particles 18 from the imaging surface 11. In this figure the cleaning blade is flexible whereas in FIG. 5 the wiper blade is substantially inflexible (i.e. stiff, less flexible, substantially rigid). A blade holder 93 is provided to support blade 90 in a sealing contact with surface 11. Cleaning blade edge 95 is located where blade 90 and imaging surface 11 meet to form a sealing contact. The cleaning blade edge 95 is in frictional contact with the imaging surface 11 as the imaging surface 11 moves in the direction 12 indicated in FIG. 3.

Cleaning blade 90 is made from a urethane member or similar material which tucks 110. (Tucking is the slight curvature that occurs at the blade edge 95 when there is relative motion between the surface 11 and the cleaning blade 90 due to the frictional forces created therein.) The flexibility of the cleaning blade 90 in conjunction with the appropriate frictional contact between the surface 11 and the blade 90 allows the wiping mode cleaning edge 95 to flip to the abrasive cleaning edge 96 that operates in the doctoring mode as shown in FIG. 2(*b*). A factor in achieving the appropriate frictional force for this flipping motion to occur, is the reversal of the photoconductive surface 11 moving in the direction of arrow 12 to the direction of arrow 13.

Another factor is the flexibility of the cleaning blade 90 which is affected by the thickness of the blade and the free length of the blade 90 from the blade holder. The free length of blade 90 extending from the blade holder 93 is about 0.2 to 0.6 inches and the thickness of blade 90 ranges from 0.040 to 0.150 inches. These dimensions enable the blade 90 to be flexible enough to flip to the abrading mode when the photoconductive surface 11 direction 12 is reversed to direction 13. The blade holder angle $\theta$ for the flexible wiper blade 90 is typically about 85°. The working angle $\beta$ of the blade 90 ranges from about 5° to about 15°. The described blade arrangement is only exemplary, and other blade arrangements are possible. Additionally, other measurements can be used to determine flexibility such as flex modulus.

Figure 3:
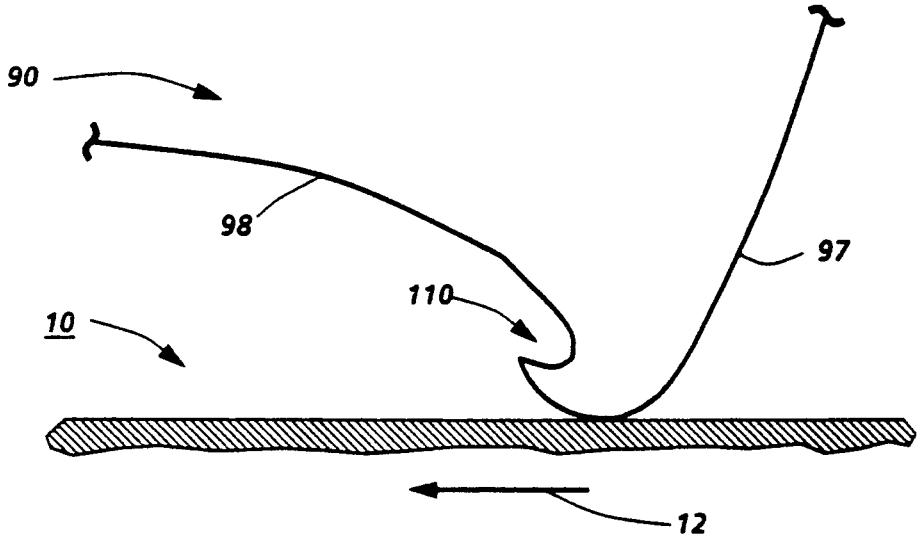
FIG. 3 is an enlarged view of the flexible wiper blade cleaning blade edge in the cleaning mode.

Referring now to FIG. 3, which shows the magnification of the tuck 110 at the blade tip 95 when the flexible wiper cleaning blade 90 is in the cleaning mode (i.e. the photoconductive surface is moving in direction 12). The air side 97 (i.e. air side refers to the side not against the mold when the cleaning blade is fabricated) is shown as the cleaning side in the flexible cleaning mode. The tuck 110 prevents the abrasive coating surface on the mold side 99 from coming into contact with the photoconductive surface 11.

Figure 4:
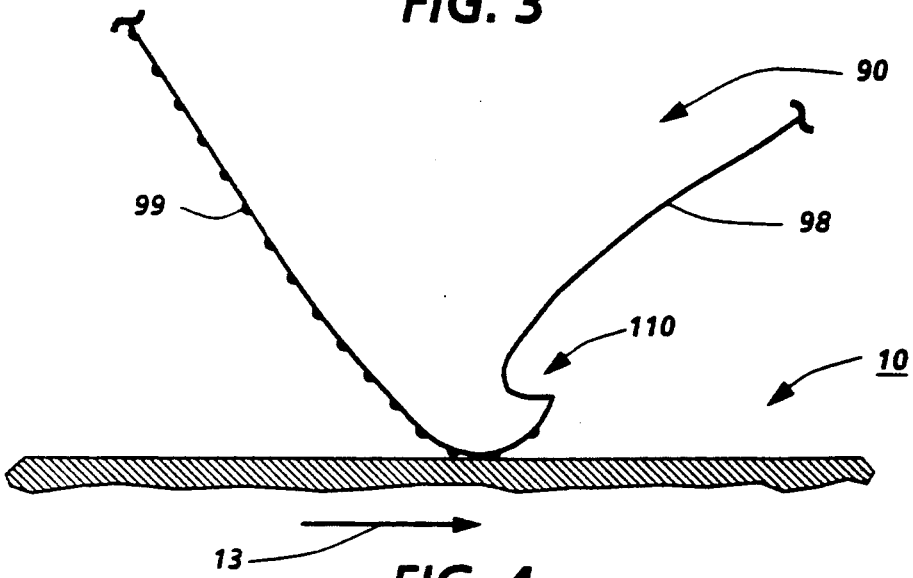
FIG. 4 is an enlarged view of the flexible wiper blade cleaning blade edge in the abrading mode.

Referring now to FIG. 4 which shows the magnification of the tuck 110 at the blade tip 96 after the blade edge has flipped from blade edge 95. FIG. 4 shows the abrasive coating on a flexible wiper blade 90 in contact with the surface 11 after the photoconductive surface 11 is reversed to direction 13. Reversal of the photoconductive surface 11 to direction 13 is called the abrading mode.

Figure 5:
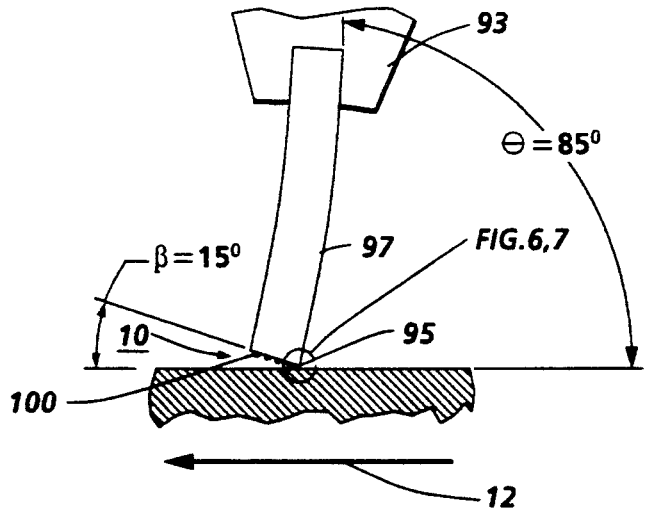
FIG. 5 is a schematic elevational view illustrating a substantially inflexible wiper blade configuration than in FIG. 2 of the cleaning blade.

Referring now to FIG. 5 which shows a cleaning blade 90 in a wiper mode cleaning relationship with a photoconductive surface 11 of belt 10. A blade holder 93 is provided to support blade 90 in a sealing contact with surface 11. The cleaning blade edge 95 is in frictional contact with the imaging surface 11 as the imaging surface 11 moves in the direction 12 indicated in FIG. 3. In this figure the cleaning blade 90 is substantially inflexible than that depicted in FIG. 3 due to the different free length extending from the blade holder 93 and the different thickness of the blade. For a substantially inflexible (i.e. substantially rigid) blade 90, the free length extending from the blade holder 93 ranges from 0.2 to 0.6 inches and the thickness of the blade ranges from 0.040 to 0.150 inches. It is also possible to reduce flexibility of the blade by a change in material (i.e. changing the cross-link density of polyurethane). The blade holder angle $\theta$ for the substantially inflexible wiper blade 90 is typically about 85°. The working angle $\beta$ of the blade 90 ranges from about 5° to about 15°. The described blade arrangement is only exemplary, and other blade arrangements are possible. Additionally, other measurements can be used to determine flexibility such as flex modulus.

Figure 6:
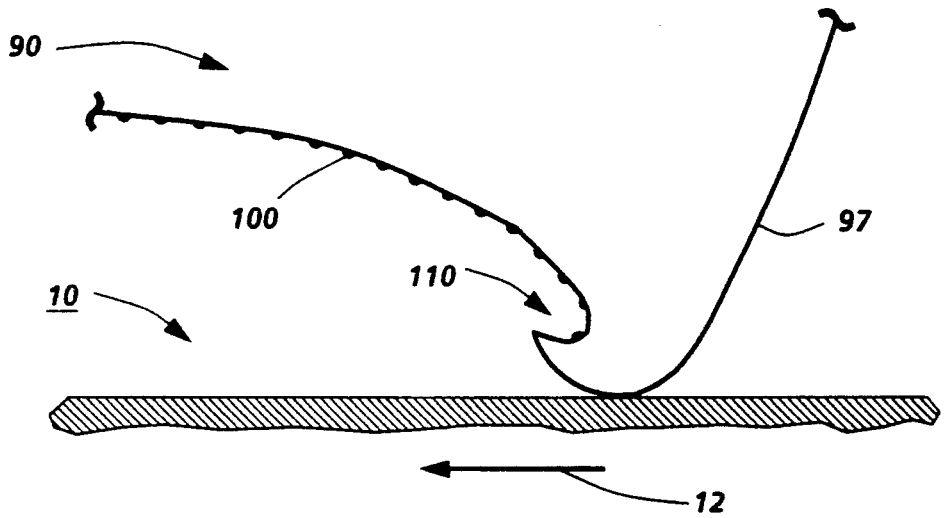
FIG. 6 is an enlarged view of the substantially inflexible wiper blade cleaning blade edge in the cleaning mode.

Referring now to FIG. 6 which shows the magnification of the tuck 110 a the blade tip 95 when the flexible wiper cleaning blade 90 is in the cleaning mode (i.e. the photoconductive surface is moving in direction 12) with the air side 97 as the cleaning edge. The tuck 110 shown prevents the abrasive coating on the cut edge 100 from coming into contact with the photoconductive surface 11.

Figure 7:
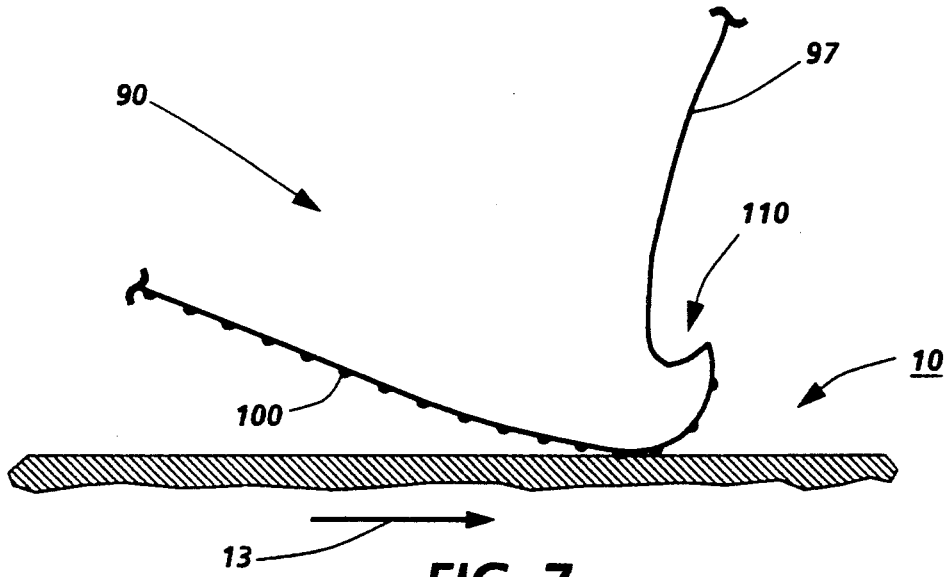
FIG. 7 is an enlarged view of the substantially inflexible wiper blade cleaning blade edge in the abrading mode.

Referring now to FIG. 7 which shows the magnification of the tuck 110 at the blade tip when the blade 90 is in the abrading mode (i.e. the photoconductive surface is moving in direction 13). The reduced flexibility of the cleaning blade 90 in conjunction with the appropriate frictional contact between the surface 11 and the blade 90 allows the cleaning edge 95 to reverse the tuck 110 (unlike the flipping motion of FIGS. 2–4), allowing the abrasive cleaning edge on the cut edge 100 to form a sealing contact with the photoconductive surface 11 when the movement direction 12 is reversed to direction 13. FIG. 7 shows that the abrasive coating edge 100 forms a sealing contact with the surface when the tuck 110 at the same blade tip as the cleaning mode, reverses it's direction in order to engage the abrading mode.

Referring now to FIG. 8 which shows a cleaning blade 90 in a doctoring mode cleaning relationship with a photoconductive surface 11 of belt 10. A blade holder 93 is provided to support cleaning blade 90 in a sealing contact with surface 11. Cleaning blade edge 95 is located where blade 90 and imaging surface 11 meet to form a sealing contact. In the doctoring mode that is depicted in FIG. 8, the cleaning blade edge 95 acts as a scraper in removing the residual particles 18 from the imaging surface 11. The cleaning blade edge 95 is in frictional contact with the imaging surface 11 as the imaging surface 11 moves in the direction 12 indicated.

The blade holder angle $\theta$ typically ranges from about 10° to about 25°. The working angle $\beta$ of the urethane blade 90 ranges from about 5° to about 15°. Typically the free length of blade 90 extending from blade holder 93 is about 0.2 to 0.6 _inches and the thickness of blade 90 ranges from 0.040 to 0.150 inches. The described blade arrangement is only exemplary, and other blade arrangements are possible. Additionally, other measurements can be used to determine flexibility such as flex modulus.

Figure 9:
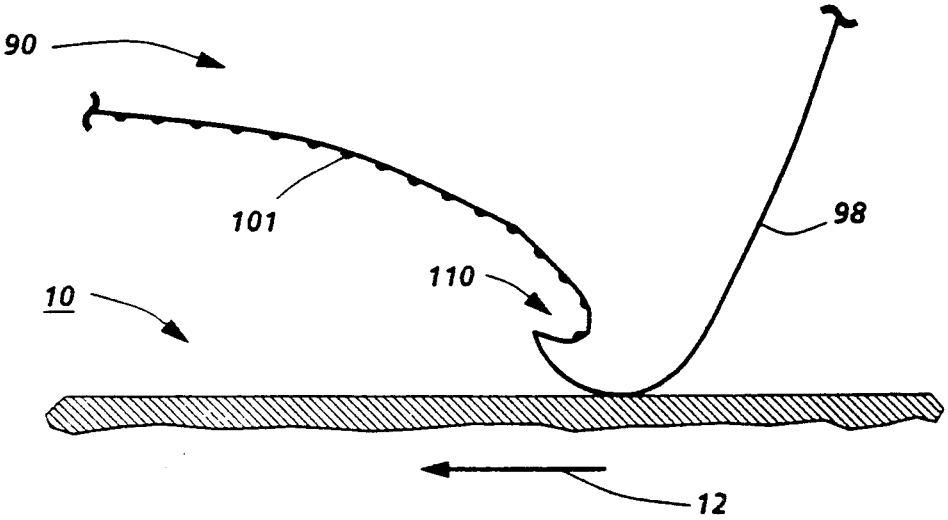
FIG. 9 is an enlarged view of the doctor blade configuration in the cleaning mode.

Referring now to FIG. 9 which shows the magnification of the tuck 110 a the blade tip when the cleaning blade 90 is in the doctoring cleaning mode. (i.e. the photoconductive surface is moving in direction 12) with the cut side 98 (i.e. cut side is the side facing the cutting apparatus when the cleaning blade 90 was cut from the urethane sheet material). The tuck 110 shown prevents the abrasive coating on the air side 101 from coming into contact with the photoconductive surface 11 in the same manner as in FIG. 6.

Referring now to FIG. 10 which shows the magnification of the tuck 110 at the blade tip when the blade 90 is in the abrading mode (i.e. the photoconductive surface is moving in direction 13). The reduced flexibility of the cleaning blade 90 in conjunction with the appropriate frictional contact between the surface 11 and the blade 90 allows the cleaning edge 95 to reverse the tuck 110. Allowing the abrasive cleaning edge on the cut edge 100 to form a sealing contact with the photoconductive surface 11 when the movement direction 12 is reversed to direction 13. FIG. 10 shows that the abrasive coating edge 101 forms a sealing contact with the surface when the tuck 110 at the same blade tip as the cleaning mode reverses to direction 13 for the abrading mode.

In recapitulation, it is evident that the cleaning blade of the present invention is a dual action cleaner blade which is similar to a conventional blade except that it has an abrasive coating on the reverse side. The reverse side has a higher cleaning effectiveness than the front side and also a higher wear function. The conventional side is engaged for the cleaning mode and the (i.e. reverse) side is engaged for the abrading mode hence, the dual action blade. The manner in which the blade's abrading mode goes into affect depends upon whether the blade is in the wiper or doctor mode. If in the wiper mode, the abrading mode is activated differently depending on the degree of flexibility in the blade. However, the reversal of the photoreceptor surface is the initiator of using the abrasive mode whether it be due to frictional flipping of the cleaning edge or changing the direction of the tuck. When used in an intelligent Electronic Reprographic machine which has the capability of detecting cleaner defects through an image scan of a standard test pattern, the reverse side of the blade can be engaged by reversing the photoreceptor. This reversing action can be implemented only as required thus maintaining belt life as long as possible while preventing service calls. The number of reverse action will be tracked by the control and used as an input to the belt life prediction routine. It is noted that although different sides (i.e. cut, air, mold) have been referred to in the above specification, for use in the cleaning and abrading mode of the present invention, the best side for cleaning is the edge adjacent to the air side and the worse side for cleaning is the edge adjacent to the mold side.

It is, therefore, apparent that there has been provided in accordance with the present invention, a dual action cleaning blade for removing particles from the photoconductive surface that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An electrophotographic printing machine of the type having a movable photoconductive surface with residual particles thereon, wherein the improvement for removal of said residual particles comprises:

means for cleaning residual particles from the photoconductive surface, said cleaning means having a cleaning surface and an abrading surface; and means for providing bidirectional relative movement between the photoconductive surface and a blade so that in one direction said abrading surface engages the photoconductive surface and in the other direction a said cleaning surface engages the photoconductive surface.

2. A printing machine as recited in claim 1, wherein said cleaning means includes:

a frame; and a dual action cleaning blade, having one free end defining an edge, pressing against the photoconductive surface with the other end being supported on said frame.

3. A printing machine as recited in claim 2, wherein said dual action cleaning blade has an abrading surface and a cleaning surface.

4. A printing machine as recited in claim 3, wherein said blade is flexible.

5. A printing machine as recited in claim 4, wherein the flexible blade has a thickness ranging from about 0.040 to 0.150 inches; and the free length extension from the blade holder is about 0.2 to 0.6 inches.

6. A printing machine as recited in claim 3, wherein said blade is substantially inflexible.

7. A printing machine as recited in claim 6, wherein the substantially inflexible blade has a thickness ranging from about 0.40 to 0.150 inches; and the free length extension from the blade holder is about 0.2 to 0.6 inches.

8. A printing machine as recited in claim 3, wherein said blade material is an elastomer.

9. A printing machine as recited in claim 8, wherein said elastomer is chosen from the group of materials consisting of Polyester and Polyether Polyurethanes.

10. A printing machine as recited in claim 3, wherein the abrading surface is created by an abrasive coating on one side of said blade.

11. A printing machine as recited in claim 10, wherein said abrasive coating material is chosen from the group of materials consisting of aluminum oxide, silicon carbide, diamond, emery, corundum, quartz and garnet grits.

12. A printing machine as recited in claim 10, wherein to remove stubborn debris particles a reversal of the photoconductive surface direction of movement causes the free end of said blade in a flexible wiper mode to flip to the abrasive coating side such that the abrasive coating side of said free end of said blade presses against the photoconductive surface defining an edge to remove the stubborn particles.

13. A printing machine as recited in claim 10, wherein to remove stubborn debris particles a reversal of the photoconductive surface direction of movement causes the free end of said blade in a substantially inflexible wiper mode to flip to the abrasive coating side such that the abrasive coating side of said free end of said blade presses against the photoconductive surface defining an edge to remove the stubborn particles.

14. A printing machine as recited in claim 10, wherein to remove stubborn debris particles a reversal of the photoconductive surface direction of movement causes the free end of said blade, in a doctor mode, to switch to a wiper blade orientation causing the abrasive coating side of said free end of said blade to press against the photoconductive surface defining an edge to remove the stubborn particles.

15. A dual function blade adapted to remove contaminates from a surface, comprising:

an abrading surface;

a cleaning surface; and means for providing bidirectional relative movement between the surface and the blade so that in one direction said abrading surface engages the surface and in the other direction said cleaning surface engages the surface.

16. A dual function blade as recited in claim 15, wherein said blade is flexible.

17. A dual function blade as recited in claim 16, wherein the flexible blade has a thickness ranging from about 0.040 to 0.150 inches; and the free length extension from the blade holder is about 0.2 to 0.6 inches.

18. A dual function blade as recited in claim 15, wherein said blade is substantially inflexible.

19. A dual function blade as recited in claim 18, wherein the substantially inflexible blade has a thickness ranging from about 0.40 to 0.150 inches; and the free length extension from the blade holder is about 0.2 to 0.6 inches.

20. A dual function blade as recited in claim 15, wherein the abrading surface is created by an abrasive coating on one side of said blade.

21. A dual function blade as recited in claim 20, wherein said abrasive coating material is chosen from the group of materials consisting of aluminum oxide, silicon carbide, diamond, emery, corundum, quartz and garnet grits.

22. A dual function blade as recited in claim 15, wherein said blade material is an elastomer.

23. A dual function blade as recited in claim 22, wherein said elastomer material is chosen from the group of materials consisting of Polyester and Polyether Polyurethanes.

* * * * *